US009825352B2

(12) United States Patent
Vance et al.

(10) Patent No.: US 9,825,352 B2
(45) Date of Patent: Nov. 21, 2017

(54) WIRELESS ELECTRONIC DEVICES INCLUDING A FEED STRUCTURE CONNECTED TO A PLURALITY OF ANTENNAS

(71) Applicant: Sony Corporation, Tokyo (JP)

(72) Inventors: Scott Vance, Staffanstorp (SE); Rune So, Copenhagen N (DK)

(73) Assignee: SONY MOBILE COMMUNICATIONS INC., Tokyo (JP)

( * ) Notice: Subject to any disclaimer, the term of this patent is extended or adjusted under 35 U.S.C. 154(b) by 468 days.

(21) Appl. No.: 13/943,388

(22) Filed: Jul. 16, 2013

(65) Prior Publication Data

US 2014/0375509 A1 Dec. 25, 2014

Related U.S. Application Data

(60) Provisional application No. 61/837,371, filed on Jun. 20, 2013.

(51) Int. Cl.
*H01Q 1/24* (2006.01)
*H01Q 9/42* (2006.01)
*H01Q 21/30* (2006.01)

(52) U.S. Cl.
CPC ..... *H01Q 1/243* (2013.01); *H01Q 9/42* (2013.01); *H01Q 21/30* (2013.01)

(58) Field of Classification Search
CPC ..... H01Q 1/243; H01Q 9/42; H01Q 21/30
See application file for complete search history.

(56) References Cited

U.S. PATENT DOCUMENTS 7,889,139 B2 * 2/2011 Hobson ..... H01Q 1/243 343/702
2003/0058177 A1 3/2003 Nishikido et al.
2006/0244663 A1 * 11/2006 Fleck ..... G06F 1/1616 343/700 MS
2008/0316116 A1 12/2008 Hobson et al.
2009/0153407 A1 6/2009 Zhang et al.
2011/0128190 A1 6/2011 Galeev
2011/0241949 A1 10/2011 Nickel et al.
(Continued)

FOREIGN PATENT DOCUMENTS

EP 2498336 A2 9/2012

OTHER PUBLICATIONS

Notification of Transmittal of the International Search Report and the Written Opinion of the International Searching Authority, or the Declaration, in corresponding PCT Application No. PCT/JP2014/002728 dated Sep. 1, 2014 (11 pages).
(Continued)

*Primary Examiner* — Robert Karacsony
*Assistant Examiner* — Amal Patel
(74) *Attorney, Agent, or Firm* — Myers Bigel, P.A.

(57) ABSTRACT

Wireless electronic devices are provided. A wireless electronic device may include a ground plane and a metal perimeter around the ground plane. The metal perimeter may include a first antenna radiating element. The wireless electronic device may include a second antenna radiating element between the ground plane and the metal perimeter. Moreover, the wireless electronic device may include a feed structure connected to the second antenna radiating element and the metal perimeter.

15 Claims, 18 Drawing Sheets

(56) References Cited

U.S. PATENT DOCUMENTS

| | | | | |
|---|---|---|---|---|
| 2011/0263289 | A1 | 10/2011 | Vance | |
| 2012/0229347 | A1* | 9/2012 | Jin | H01Q 1/243 343/702 |
| 2013/0027254 | A1 | 1/2013 | Korva et al. | |
| 2013/0050046 | A1 | 2/2013 | Jarvis et al. | |
| 2013/0057437 | A1* | 3/2013 | Chiu | H01Q 1/243 343/702 |
| 2014/0274231 | A1* | 9/2014 | De Luis | H01Q 5/321 455/575.7 |

OTHER PUBLICATIONS

Notification Concerning Transmittal of International Preliminary Report on Patentability in corresponding PCT Application No. PCT/JP2014/002728, dated Dec. 30, 2015 (8 pages).

* cited by examiner

WIRELESS ELECTRONIC DEVICES INCLUDING A FEED STRUCTURE CONNECTED TO A PLURALITY OF ANTENNAS

CLAIM OF PRIORITY

The present application claims the benefit of U.S. Provisional Patent Application Ser. No. 61/837,371, filed on Jun. 20, 2013, entitled Wireless Electronic Devices Including a Feed Structure Connected to a Plurality of Antennas, the disclosure of which is hereby incorporated herein in its entirety by reference.

FIELD

The present inventive concepts generally relate to the field of communications and, more particularly, to antennas and wireless electronic devices incorporating the same.

BACKGROUND

Wireless electronic devices may include a metal perimeter exposed to users of the wireless electronic devices. Although the metal perimeter may be used as an antenna, performance of the antenna may be relatively weak in some frequency bands.

SUMMARY

Various embodiments of the present inventive concepts include a wireless electronic device. The wireless electronic device may include a metal perimeter around (e.g., substantially continuously around) a ground plane, and the metal perimeter may include a first antenna radiating element. The wireless electronic device may include a second antenna radiating element between the ground plane and the metal perimeter. Moreover, the wireless electronic device may include a feed structure connected to the second antenna radiating element and the metal perimeter. In some embodiments, the feed structure may extend from the second antenna radiating element along a surface of the metal perimeter to a location adjacent a ground point between the metal perimeter and the ground plane. The second antenna radiating element may be a monopole antenna between the ground plane and the first antenna. Moreover, the first antenna radiating element may be a non-planar antenna of the metal perimeter.

In various embodiments, the wireless electronic device may include a matching component between the feed structure and the ground plane. The matching component may be configured to provide a capacitance of about 0.8 picoFarads (pF) to about 1.5 pF.

According to various embodiments, the metal perimeter may include a third antenna radiating element physically connected to the feed structure. Alternatively, the feed structure may include a first coaxial feed line physically connected to the first antenna radiating element of the metal perimeter, the metal perimeter may include a third antenna radiating element, and the wireless electronic device may include a second coaxial feed line physically connected to the third antenna radiating element of the metal perimeter.

In various embodiments, the feed structure may include a coaxial feed line connected to the second antenna radiating element and the metal perimeter. Additionally or alternatively, the feed structure may be at least partially recessed in the metal perimeter.

According to various embodiments, the metal perimeter may include a non-planar portion including at least a portion of the first antenna radiating element. The feed structure may include a non-planar portion extending along the non-planar portion of the metal perimeter. Moreover, the wireless electronic device may include a display screen on the ground plane, and a transceiver circuit coupled to the first antenna radiating element and configured to provide communications for the wireless electronic device.

A wireless electronic device, according to various embodiments, may include a ground plane, a display screen on the ground plane, and a metal perimeter around the ground plane. The metal perimeter may include a non-planar first antenna radiating element. The wireless electronic device may include a second antenna radiating element between the ground plane and the metal perimeter. The wireless electronic device may include a feed structure connected to the second antenna radiating element and the metal perimeter. Moreover, the wireless electronic device may include a transceiver circuit coupled to the non-planar first antenna radiating element and configured to provide communications for the wireless electronic device.

In various embodiments, the feed structure may extend from the second antenna radiating element along a surface of the metal perimeter to a location adjacent a ground point between the metal perimeter and the ground plane. The feed structure may include a coaxial feed line connected to the second antenna radiating element and the metal perimeter. Moreover, the ground point may include a conductor of the coaxial feed line. Additionally or alternatively, the second antenna radiating element may be a monopole antenna between the ground plane and the non-planar first antenna radiating element.

According to various embodiments, the wireless electronic devices may include a matching component between the feed structure and the ground plane. The matching component may be configured to provide a capacitance of about 0.8 picoFarads (pF) to about 1.5 pF.

In various embodiments, the metal perimeter may include a non-planar third antenna radiating element physically connected to the feed structure. In some embodiments, the feed structure may include a coaxial feed line connected to the second antenna radiating element and the metal perimeter and at least partially recessed in the metal perimeter. Additionally or alternatively, the feed structure may include a non-planar portion extending along a portion of the non-planar first antenna radiating element.

Other devices and/or systems according to embodiments of the inventive concepts will be or become apparent to one with skill in the art upon review of the following drawings and detailed description. It is intended that all such additional devices and/or systems be included within this description, be within the scope of the present inventive concepts, and be protected by the accompanying claims. Moreover, it is intended that all embodiments disclosed herein can be implemented separately or combined in any way and/or combination.

DETAILED DESCRIPTION OF EMBODIMENTS

Figure 1:
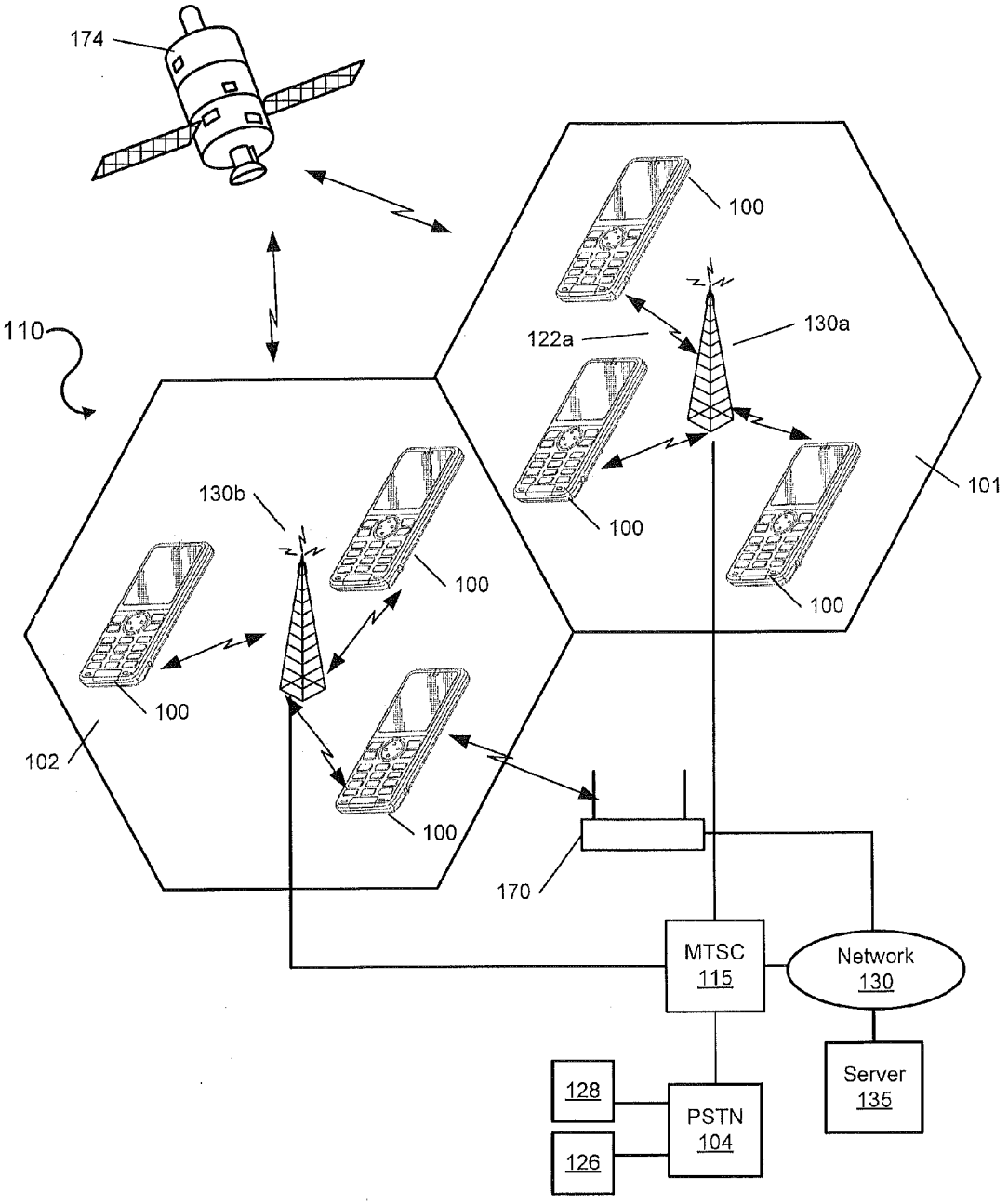
FIG. 1 is a schematic illustration of a wireless communications network that provides service to wireless electronic devices, according to various embodiments of the present inventive concepts.

The present inventive concepts now will be described more fully with reference to the accompanying drawings, in which embodiments of the inventive concepts are shown. However, the present application should not be construed as limited to the embodiments set forth herein. Rather, these embodiments are provided so that this disclosure will be thorough and complete, and to fully convey the scope of the embodiments to those skilled in the art. Like reference numbers refer to like elements throughout.

The terminology used herein is for the purpose of describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including," when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments.

Unless otherwise defined, all terms (including technical and scientific terms) used herein have the same meaning as commonly understood by one of ordinary skill in the art to which these embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For purposes of illustration and explanation only, various embodiments of the present inventive concepts are described herein in the context of "wireless electronic devices." Among other devices/systems, wireless electronic devices may include multi-band wireless communication terminals (e.g., portable electronic devices/wireless terminals/mobile terminals/terminals) that are configured to carry out cellular communications (e.g., cellular voice and/or data communications) in more than one frequency band. It will be understood, however, that the present inventive concepts are not limited to such embodiments and may be embodied generally in any device and/or system that is configured to transmit and receive in one or more frequency bands. Moreover, the terms "about" and "substantially," as described herein, mean that the recited number or value can vary by up to +/−25%.

Although a metal perimeter along the exterior of a wireless electronic device may be used as an antenna, performance of the antenna as measured by gain or frequency bandwidth may be relatively weak in low frequency bands. For example, when the metal perimeter is grounded and fed at various discrete locations around the metal perimeter, antenna correlation performance may be relatively weak in band 17 (e.g., including 704-746 Megahertz (MHz) frequencies), but may be relatively good in other bands. Moreover, freespace performance of the antenna (e.g., performance when the wireless electronic device is not contacting anything) may be relatively weak, whereas antenna losses caused by a user's hand contacting the wireless electronic device may be relatively moderate. Various embodiments of the wireless electronic devices described herein, however, may include a feed structure that is physically connected to a plurality of antennas. For example, a metal perimeter of a wireless electronic device may include a single antenna or a plurality of antennas, an additional antenna may be located between the metal perimeter and a ground plane of the wireless electronic device, and a feed structure may physically connect with both the metal perimeter and the additional antenna that is between the metal perimeter and the ground plane. In particular, the feed structure may excite both the metal perimeter and the additional antenna that is between the metal perimeter and the ground plane, and may thereby create additional resonances that may improve the antenna gain and bandwidth of the antenna of the wireless electronic device. Accordingly, various embodiments described herein may provide a feed structure and antenna configuration that improves antenna performance characteristics.

Referring to FIG. 1, a diagram is provided of a wireless communications network 110 that supports communications in which wireless electronic devices 100 can be used according to various embodiments of the present inventive concepts. The network 110 includes cells 101, 102 and base stations 130*a*, 130*b* in the respective cells 101, 102. Networks 110 are commonly employed to provide voice and data communications to subscribers using various radio access standards/technologies. The network 110 may include wireless electronic devices 100 that may communicate with the base stations 130*a*, 130*b*. The wireless electronic devices 100 in the network 110 may also communicate with a Global Positioning System (GPS) satellite 174, a local wireless network 170, a Mobile Telephone Switching Center (MTSC) 115, and/or a Public Service Telephone Network (PSTN) 104 (i.e., a "landline" network).

The wireless electronic devices 100 can communicate with each other via the Mobile Telephone Switching Center (MTSC) 115. The wireless electronic devices 100 can also communicate with other devices/terminals, such as terminals 126, 128, via the PSTN 104 that is coupled to the network 110. As also shown in FIG. 1, the MTSC 115 is coupled to a computer server 135 via a network 130, such as the Internet.

The network 110 is organized as cells 101, 102 that collectively can provide service to a broader geographic region. In particular, each of the cells 101, 102 can provide service to associated sub-regions (e.g., regions within the hexagonal areas illustrated by the cells 101, 102 in FIG. 1) included in the broader geographic region covered by the network 110. More or fewer cells can be included in the network 110, and the coverage area for the cells 101, 102 may overlap. The shape of the coverage area for each of the cells 101, 102 may be different from one cell to another and is not limited to the hexagonal shapes illustrated in FIG. 1. The base stations 130*a*, 130*b* in the respective cells 101, 102 can provide wireless communications between each other and the wireless electronic devices 100 in the associated geographic region covered by the network 110.

Each of the base stations 130*a*, 130*b* can transmit/receive data to/from the wireless electronic devices 100 over an associated control channel. For example, the base station 130*a* in cell 101 can communicate with one of the wireless electronic devices 100 in cell 101 over the control channel 122*a*. The control channel 122*a* can be used, for example, to page the wireless electronic device 100 in response to calls directed thereto or to transmit traffic channel assignments to the wireless electronic device 100 over which a call associated therewith is to be conducted.

The wireless electronic devices 100 may also be capable of receiving messages from the network 110 over the respective control channels 122*a*. In various embodiments according to the inventive concepts, the wireless electronic devices 100 receive Short Message Service (SMS), Enhanced Message Service (EMS), Multimedia Message Service (MMS), and/or Smartmessaging™ formatted messages.

The GPS satellite 174 can provide GPS information to the geographic region including cells 101, 102 so that the wireless electronic devices 100 may determine location information. The network 110 may also provide network location information as the basis for the location information applied by the wireless electronic devices 100. In addition, the location information may be provided directly to the server 135 rather than to the wireless electronic devices 100 and then to the server 135. Additionally or alternatively, the wireless electronic devices 100 may communicate with the local wireless network 170.

Figure 2A:
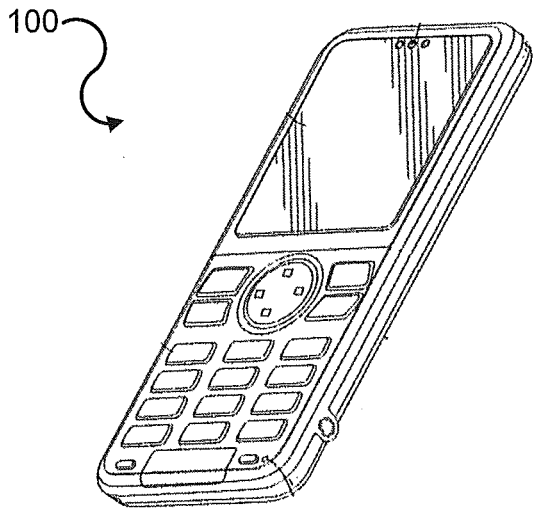
FIGS. 2A and 2B illustrate front and rear views, respectively, of a wireless electronic device, according to various embodiments of the present inventive concepts.
Figure 2B:
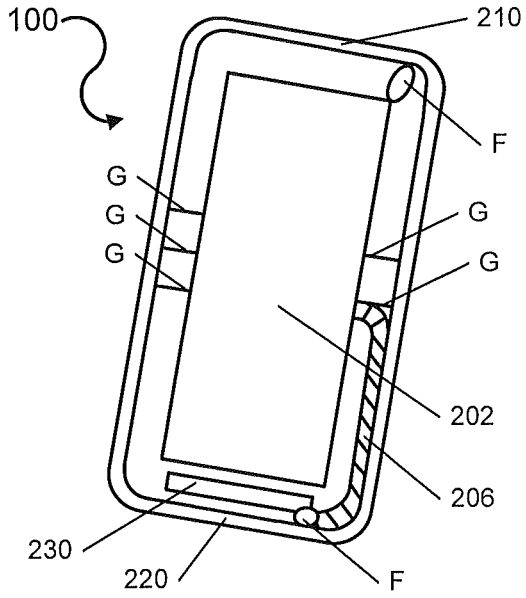

FIGS. 2A and 2B illustrate front and rear views, respectively, of a wireless electronic device 100, according to various embodiments of the present inventive concepts. Accordingly, FIGS. 2A and 2B illustrate opposite sides of the wireless electronic device 100. In particular, although a backplate of the wireless electronic device 100 has been removed in FIG. 2B to illustrate a feed structure 206 (illustrated using hatched lines) of the wireless electronic device 100, it will be understood that an external face of the backplate may be visible to, and/or in contact with, a user of the wireless electronic device 100. In contrast, an internal face of the backplate may face internal portions of the wireless electronic device 100, such as a transceiver circuit.

FIG. 2B further illustrates a first antenna 210 and a second antenna 220 around a ground plane 202 of the wireless electronic device 100. The ground plane 202 may be between the backplate and a front external face (e.g., a display) of the wireless electronic device 100. The first and second antennas 210, 220 may collectively form at least a portion of a metal perimeter around the ground plane 202. It will be understood that the metal perimeter may form outer surface edges (e.g., sides) of the wireless electronic device 100, and that the outer surface edges may be substantially perpendicular to the external face of the backplate of the wireless electronic device 100. Moreover, ground connections/points G may connect the first and second antennas 210, 220 to the ground plane 202.

It will be understood that the first and second antennas 210, 220 may include various types of antennas configured for wireless communications. For example, at least one of the first and second antennas 210, 220 may be a multi-band antenna and/or may be configured to communicate using cellular and/or non-cellular frequencies. As an example, the second antenna 220 may be a primary cellular antenna, whereas the first antenna 210 may be a secondary cellular antenna. Moreover, at least one of the first and second antennas 210, 220 may be a non-planar (e.g., curved) antenna defined by a portion of the metal perimeter of the wireless electronic device 100. In other words, the metal perimeter of the wireless electronic device 100 may include one or more non-planar portions, and the non-planar portion (s) may include at least a portion of one or more of the first and second antennas 210, 220. Similarly, the feed structure 206 may include a non-planar portion that extends along (e.g., substantially conforms with the shape of) a non-planar portion of the second antenna 220 of the metal perimeter.

It will also be understood that more or fewer than the two antennas 210, 220 may be included in the metal perimeter of the wireless electronic device 100. For example, the metal perimeter may include a third antenna in some embodiments. Alternatively, the metal perimeter may include only one antenna (e.g., the antenna 220). In such embodiments, the wireless electronic device 100 may operate in Single Input Single Output (SISO) configurations, or a secondary antenna may be created in a ground-free area or via a break in the opposing metal perimeter portion (e.g., the portion 210). Although the first and second antennas 210, 220 are illustrated as including portions of the top and bottom, respectively, of the metal perimeter, the first and second (or first through third, etc.) metal perimeter antennas may be rearranged at different locations of the metal perimeter. Also, any of the antennas may include a primary cellular antenna, a diversity cellular antenna, a Global Positioning System (GPS) antenna, and/or a WiFi/Bluetooth antenna.

Referring still to FIG. 2B, a third antenna 230 may be between the metal perimeter and the ground plane 202. For example, the third antenna 230 may be spaced apart from, and between, the second antenna 220 and the ground plane 202. The third antenna 230 may have a feed point F physically connected to the feed structure 206. In some embodiments, the third antenna 230 may be a monopole antenna and/or a slot antenna. The third antenna 230 may have one of various structural patterns, including a meander pattern, a loop pattern, or another pattern. Moreover, the third antenna 230 may be elevated above the ground plane 202 such that respective topmost surfaces of the metal perimeter and the third antenna 230 are substantially coplanar with each other and are substantially parallel to the external face of the backplate of the wireless electronic device 100. Additionally or alternatively, in some embodiments, the backplate of the wireless electronic device 100 may be a plastic, ceramic, or dielectric material, rather than a metal material, to improve radiation of the third antenna 230. Furthermore, it will be understood that in embodiments where the metal perimeter includes the second antenna 220 but not necessarily the first antenna 210, the second antenna 220 may be referred to as a first antenna, and the third antenna 230 may be referred to as a second antenna. It will also be understood that the second and third antennas 220, 230 may be first and second radiating elements of a combined antenna. For example, the second antenna 220 may be a first antenna radiating element that is excited by a second radiating element (e.g., the third antenna 230).

As illustrated in FIG. 2B, the feed structure 206 may extend continuously from the third antenna 230 along an interior surface (i.e., a surface that is not exposed to a user of the wireless electronic device 100) of the metal perimeter to a location adjacent a ground point G between the metal perimeter and the ground plane 202. Accordingly, the feed structure 206 may physically connect with both the metal perimeter and the third antenna 230. In particular, the feed structure 206 may excite both the metal perimeter and the third antenna 230, and may thereby provide additional resonances that may improve the antenna gain and bandwidth of the wireless electronic device 100.

As an example, the feed structure 206 may be a coaxial feed line that includes a ground portion physically connected to the metal perimeter and a feed portion physically connected to the third antenna 230. In some embodiments, the coaxial feed line may be at least partially recessed in the metal perimeter. For example, at least a portion of the coaxial feed line may be in a groove in the metal perimeter. Additionally or alternatively, the feed structure 206 may be a flex film. The flex film may be thinner (e.g., about 0.3 millimeters thick or less) than other types of feed structures, and may be easier to mount inside the wireless electronic device 100. Moreover, as the location and type of transition/connection from main ground (e.g., the ground plane 202) to the metal perimeter may be an influential tuning parameter for the first and second antennas 210, 220 in achieving the improved gain and bandwidth described herein, it will be understood that the position (e.g., including length) of the feed structure 206 may be designed/selected as desired for tuning the first and second antennas 210, 220.

Figure 3:
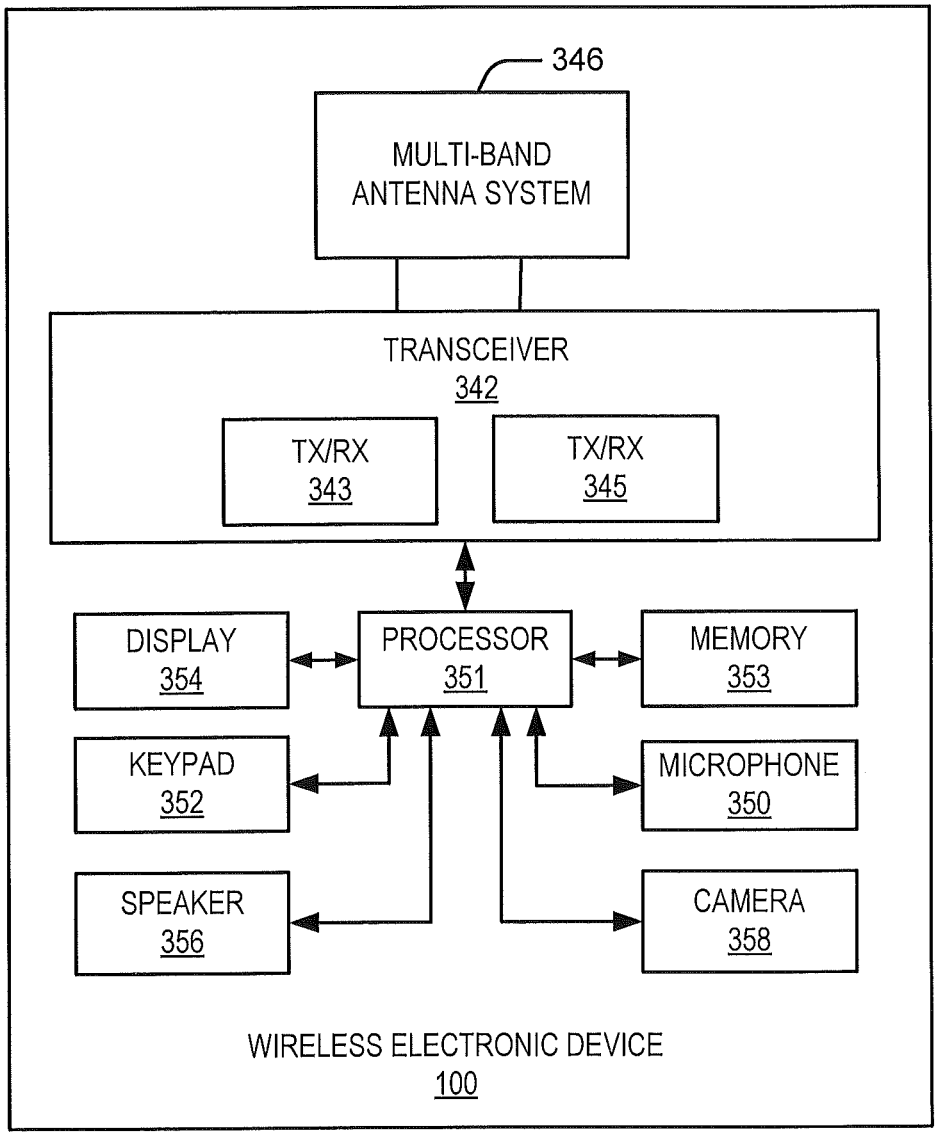
FIG. 3 is a block diagram illustrating a wireless electronic device, according to various embodiments of the present inventive concepts.

Referring now to FIG. 3, a block diagram is provided illustrating a wireless electronic device 100, according to various embodiments of the present inventive concepts. As illustrated in FIG. 3, a wireless electronic device 100 may include a multi-band antenna system 346, a transceiver 342, and a processor 351. The wireless electronic device 100 may further include a display 354, keypad 352, speaker 356, memory 353, microphone 350, and/or camera 358.

A transmitter portion of the transceiver 342 converts information, which is to be transmitted by the wireless electronic device 100, into electromagnetic signals suitable for radio communications (e.g., to the network 110 illustrated in FIG. 1). A receiver portion of the transceiver 342 demodulates electromagnetic signals, which are received by the wireless electronic device 100 from the network 110 to provide the information contained in the signals in a format understandable to a user of the wireless electronic device 100. The transceiver 342 may include transmit/receive circuitry (TX/RX) that provides separate communication paths for supplying/receiving RF signals to different radiating elements of the multi-band antenna system 346 via their respective RF feeds. Accordingly, when the multi-band antenna system 346 includes two active antenna elements (e.g., the first and second antennas 210, 220), the transceiver 342 may include two transmit/receive circuits 343, 345 connected to different ones of the antenna elements via the respective RF feeds.

The transceiver 342, in operational cooperation with the processor 351, may be configured to communicate according to at least one radio access technology in two or more frequency ranges. The at least one radio access technology may include, but is not limited to, WLAN (e.g., 802.11/WiFi), WiMAX (Worldwide Interoperability for Microwave Access), TransferJet, 3GPP LTE (3rd Generation Partnership Project Long Term Evolution), 4G, Time Division LTE (TD LTE), Universal Mobile Telecommunications System (UMTS), Global Standard for Mobile (GSM) communication, General Packet Radio Service (GPRS), enhanced data rates for GSM evolution (EDGE), DCS, PDC, PCS, Code Division Multiple Access (CDMA), wideband-CDMA, and/or CDMA2000. The radio access technology may operate using such frequency bands as 700-800 Megahertz (MHz), 824-894 MHz, 880-960 MHz, 1710-1880 MHz, 1820-1990 MHz, 1920-2170 MHz, 2300-2400 MHz, and 2500-2700 MHz. Other radio access technologies and/or frequency bands can also be used in embodiments according to the inventive concepts. Various embodiments may provide coverage for non-cellular frequency bands such as Global Positioning System (GPS), WLAN, and/or Bluetooth frequency bands. As an example, in various embodiments according to the inventive concepts, the local wireless network 170 (illustrated in FIG. 1) is a WLAN compliant network. In various other embodiments according to the inventive concepts, the local wireless network 170 is a Bluetooth compliant interface.

The wireless electronic device 100 is not limited to any particular combination/arrangement of the keypad 352 and the display 354. As an example, it will be understood that the functions of the keypad 352 and the display 354 can be provided by a touch screen through which the user can view information, such as computer displayable documents, provide input thereto, and otherwise control the wireless electronic device 100. Additionally or alternatively, the wireless electronic device 100 may include a separate keypad 352 and display 354.

It will be understood that the first and second antennas 210, 220 may provide substantial portions of the sides/edges of the wireless electronic device 100 between the backplate and the display 354. Moreover, it will be understood that the display 354 may be a display screen/device that is on (e.g., positioned over) the ground plane 202.

Referring still to FIG. 3, the memory 353 can store computer program instructions that, when executed by the processor circuit 351, carry out operations of the wireless electronic device 100. As an example, the memory 353 can be non-volatile memory, such as EEPROM (flash memory), that retains the stored data while power is removed from the memory 353.

Referring to FIGS. 2B and 3, each of the first, second, and third antennas 210, 220, and 230 may be connected (e.g., by one or more feed structures such as the feed structure 206) to a radio/source transceiver. As an example, each of the first, second, and third antennas 210, 220, and 230 may be connected to the transceiver circuit 342 of FIG. 3. The transceiver circuit 342 may include respective transceivers (e.g., the transceivers 343, 345, etc.) configured to provide communications using the first, second, and third antennas 210, 220, and 230. Moreover, it will be understood that one or more of the respective transceivers may be separate transceiver circuits that are not included in the transceiver circuit 342.

Figure 4A:
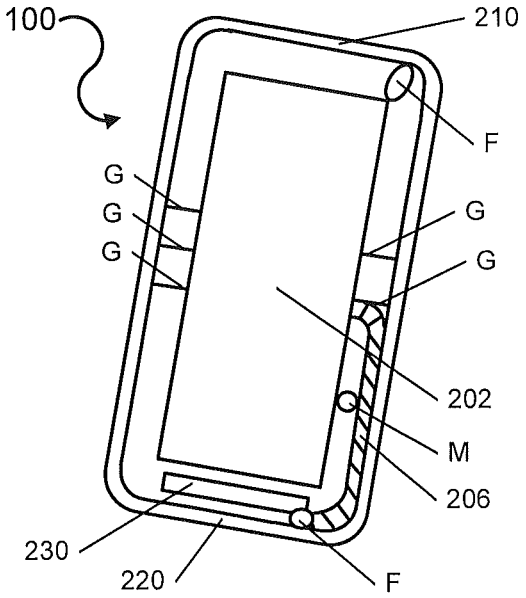
FIGS. 4A and 4B illustrate detailed views of a metal perimeter of a wireless electronic device, according to various embodiments of the present inventive concepts.
Figure 4B:
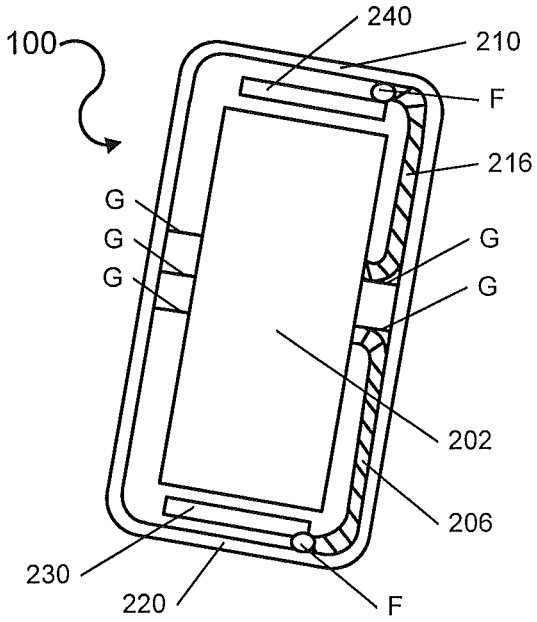

Referring now to FIGS. 4A and 4B, detailed views of a metal perimeter of a wireless electronic device 100 are illustrated, according to various embodiments of the present inventive concepts. For example, FIG. 4A illustrates that the wireless electronic device 100 may include a matching component M between the feed structure 206 and the ground plane 202. The matching component M may be electrically connected to the metal perimeter and to a conductor/ground of the feed structure 206. The matching component M may be configured to provide a capacitance of about 0.8 pico-Farads (pF) to about 1.5 pF. Accordingly, the matching component M may improve high-band resonances. In other words, the matching component M may improve tuning of the wireless electronic device 100 for high-band frequencies. Aside from the matching component M, the elements of FIG. 4A may be the same as those in FIG. 2B, and a repeated description of such common elements may therefore be omitted herein.

Referring to FIG. 4B, a wireless electronic device 100 may include the feed structure 216 in addition to the feed structure 206. The feed structures 206, 216 may be spaced apart from each other adjacent the metal perimeter of the wireless electronic device 100. For example, the feed structures 206, 216 may be respective coaxial feed lines. Moreover, if the feed structures 206, 216 are both primarily on located one side (e.g., a right side or a left side) of the metal perimeter, then correlation between the first and second antennas 210, 220 of the metal perimeter may improve. Similarly, it may be desirable to have feed points, such as the feed points F, on that same side.

Referring to FIGS. 2B, 4A, and 4B, in embodiments where the feed structure 206 is a coaxial feed line, then a conductor of the coaxial feed line may, in some embodiments, be used as ground for the metal perimeter of the wireless electronic device 100, instead of using discrete grounding points that are external to/separate from the feed structure 206. Moreover, in some embodiments, the ground (e.g., conductor) of the coaxial feed line may be physically connected to the metal perimeter at more than one location (e.g., at regular intervals). In some embodiments illustrated in FIGS. 2B and 4A, only the feed structure 206 may be used, and a feed point F of the first antenna 210 of the metal perimeter that is on the opposite end of the wireless electronic device 100 from the feed point F at the third antenna 230 thus may not be connected to the feed structure 216. Alternatively, in some embodiments illustrated in FIG. 4B, the feed structure 216 may also be provided and may extend adjacent the metal perimeter. As an example, the feed structure 216 illustrated in FIG. 4B may have the same attributes as the feed structure 206. For example, the feed structure 216 may be a coaxial feed line and/or a flex film. Additionally or alternatively, the feed structure 216 may include one or more non-planar portions and/or may be used as ground for the metal perimeter of the wireless electronic device 100. Furthermore, the feed structure 216 may feed a fourth antenna 240 at a feed point F. The fourth antenna 240 may include the same attributes (e.g., monopole antenna, etc.) as the third antenna 230.

Figure 5A:
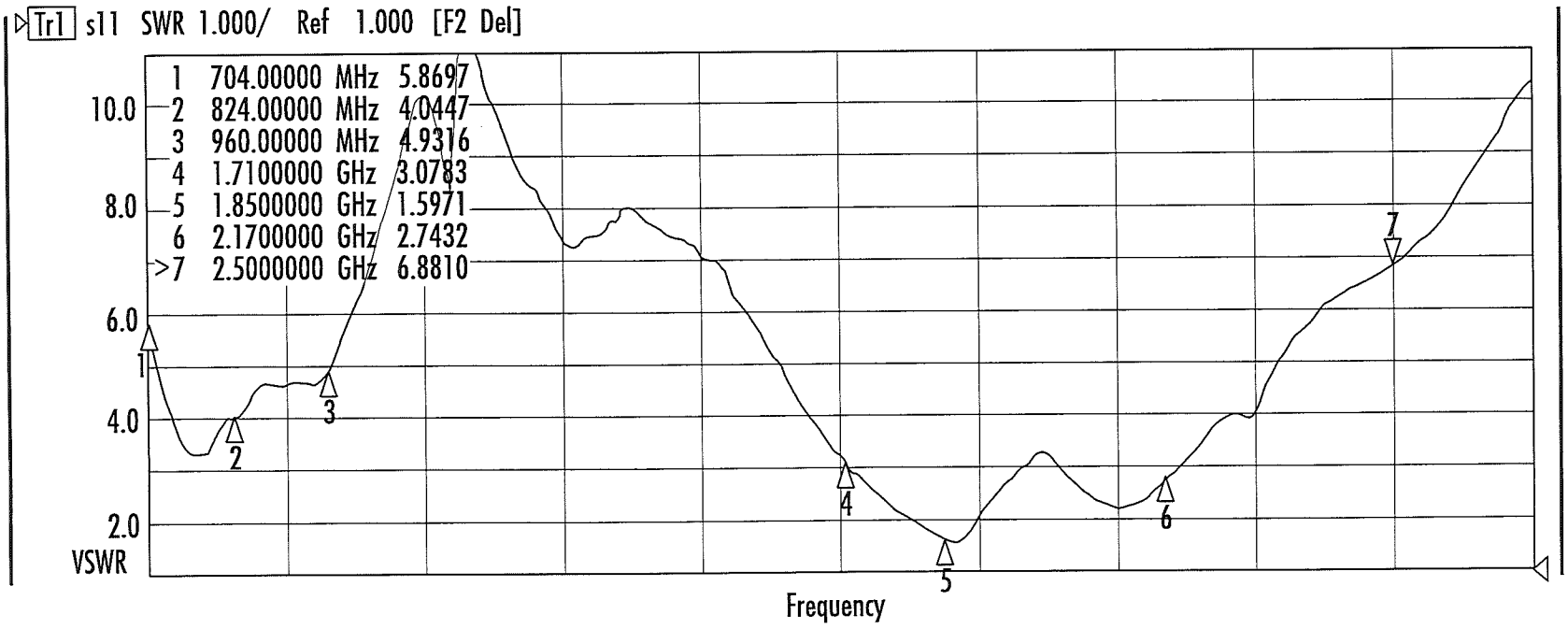
FIG. 5A (PRIOR ART)
FIG. 5A illustrates a Voltage Standing Wave Ratio (VSWR) graph of a prior art wireless electronic device.

Referring now to FIG. 5A, a Voltage Standing Wave Ratio (VSWR) graph of a prior art wireless electronic device is illustrated. Although a VSWR of 3.0 or lower may be relatively good for a wireless electronic device, FIG. 5A illustrates that a wireless electronic device without the feed structure 206 or the third antenna 230 (which are illustrated, e.g., in FIG. 2B) may provide relatively weak VSWR characteristics at lower frequencies. In particular, FIG. 5A illustrates a VSWR above 3.0 for all frequencies between 704 MHz and 960 MHz.

Figure 5B:
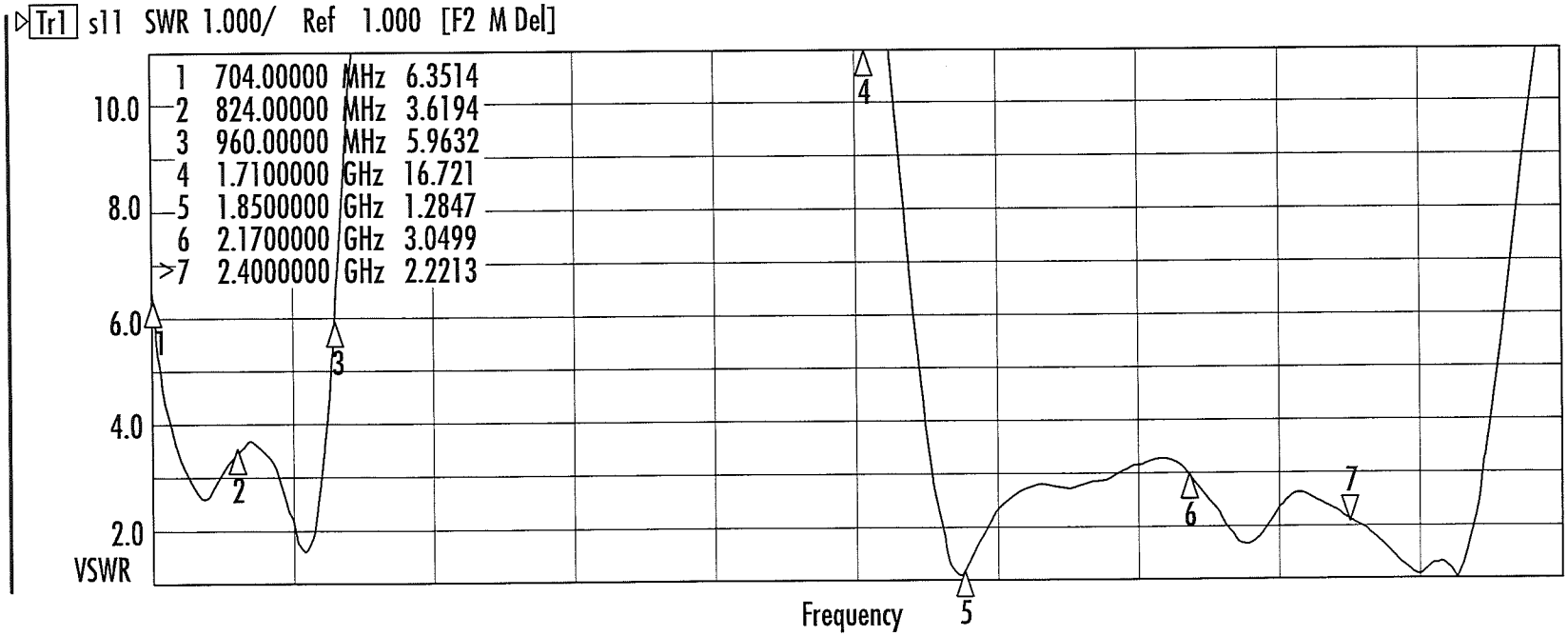
FIGS. 5B and 5C illustrate VSWR graphs of wireless electronic devices according to various embodiments of the present inventive concepts.
Figure 5C:
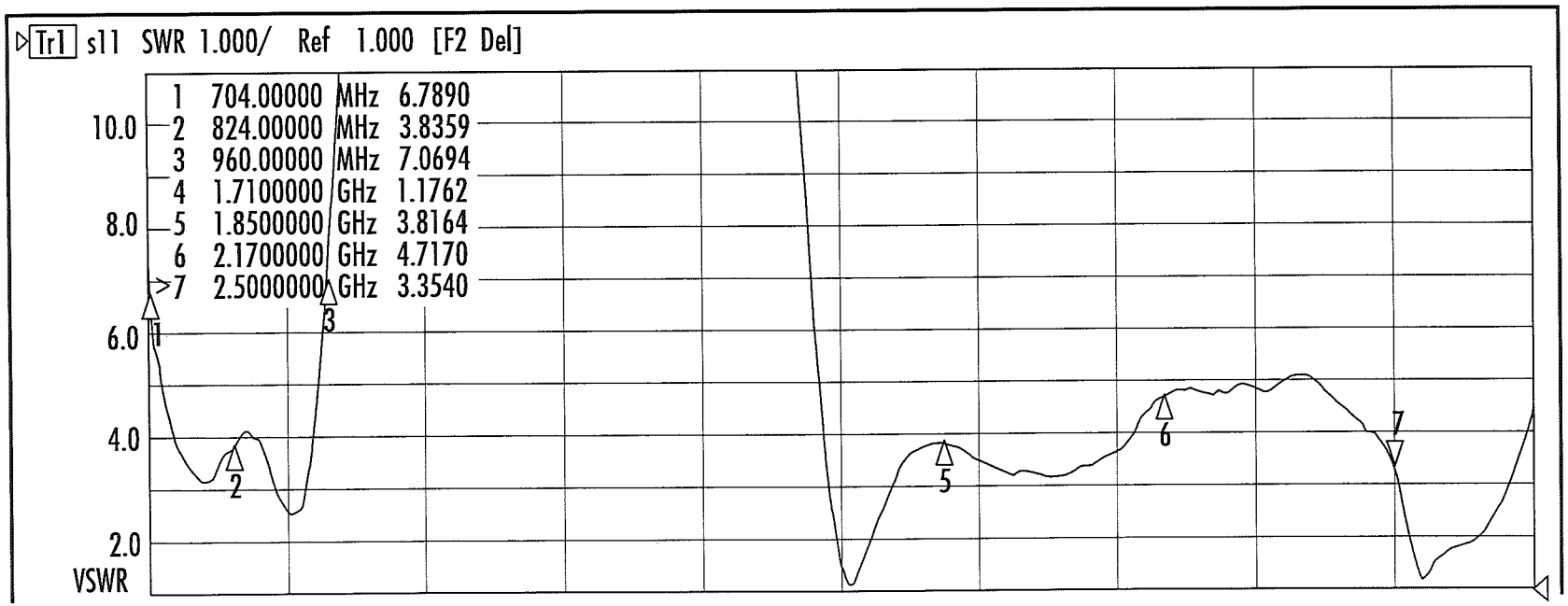

In contrast with FIG. 5A, FIGS. 5B and 5C illustrate VSWR graphs of wireless electronic devices 100 according to various embodiments of the present inventive concepts. For example, FIG. 5B illustrates that a wireless electronic device 100 including the feed structure 206 and the third antenna 230, as illustrated in FIG. 2B, may provide two low-band resonances and a VSWR below 3.0 for various low-band frequencies. As another example, FIG. 5C illustrates that a wireless electronic device 100 including the feed structure 206, the third antenna 230, and the matching component M, as illustrated in FIG. 4A, may provide two low-band resonances and a VSWR below 3.0 for some low-band frequencies.

Figure 6A:
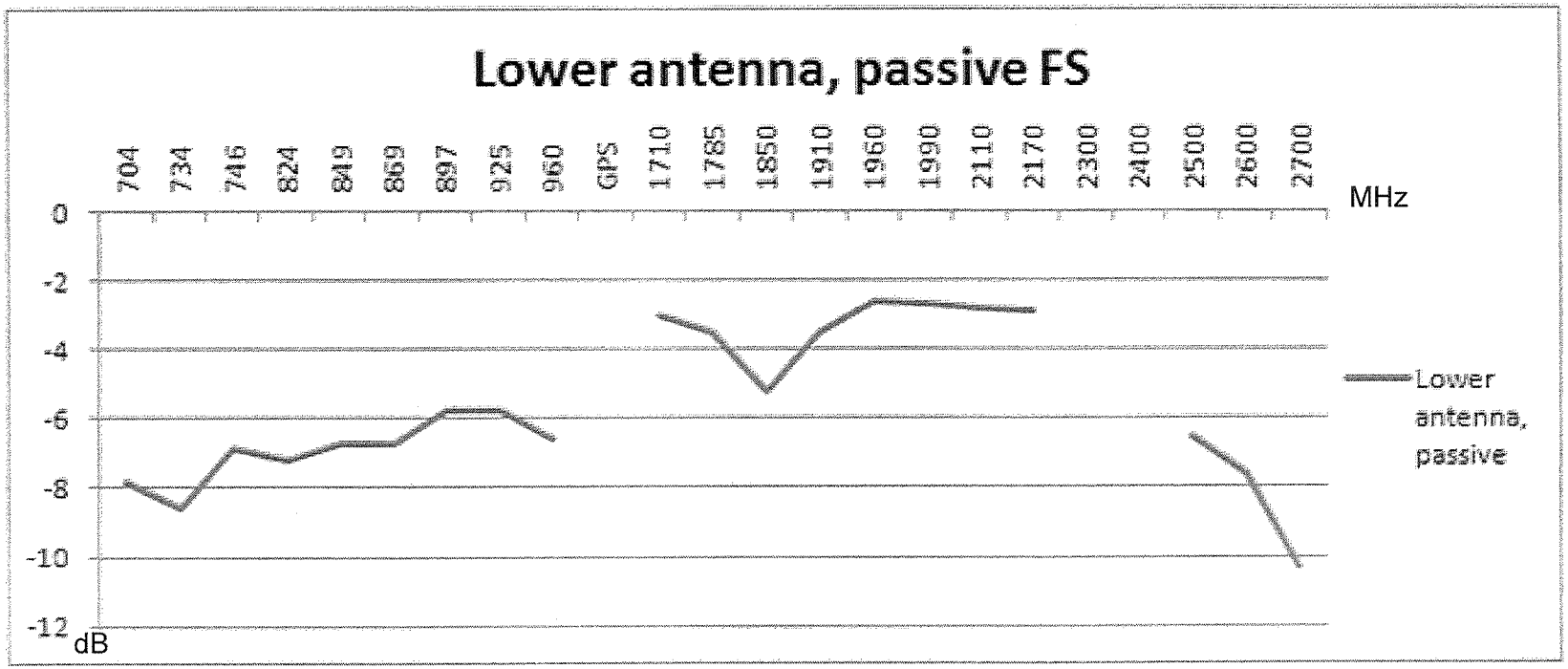
FIGURE 6A (PRIOR ART)
FIG. 6A illustrates a graph of gain of a prior art wireless electronic device.

Referring now to FIG. 6A, a graph of gain of a prior art wireless electronic device is illustrated. Although an average efficiency of 50% (e.g., a gain of −3 decibels (dB)) or higher may be relatively good for a wireless electronic device, FIG. 6A illustrates that a wireless electronic device without the feed structure 206 or the third antenna 230 may provide relatively weak average efficiency characteristics at lower frequencies. In particular, FIG. 6A illustrates an average efficiency below about 25% (e.g., a gain below about −6 dB) for most frequencies between 704 MHz and 960 MHz.

Figure 6B:
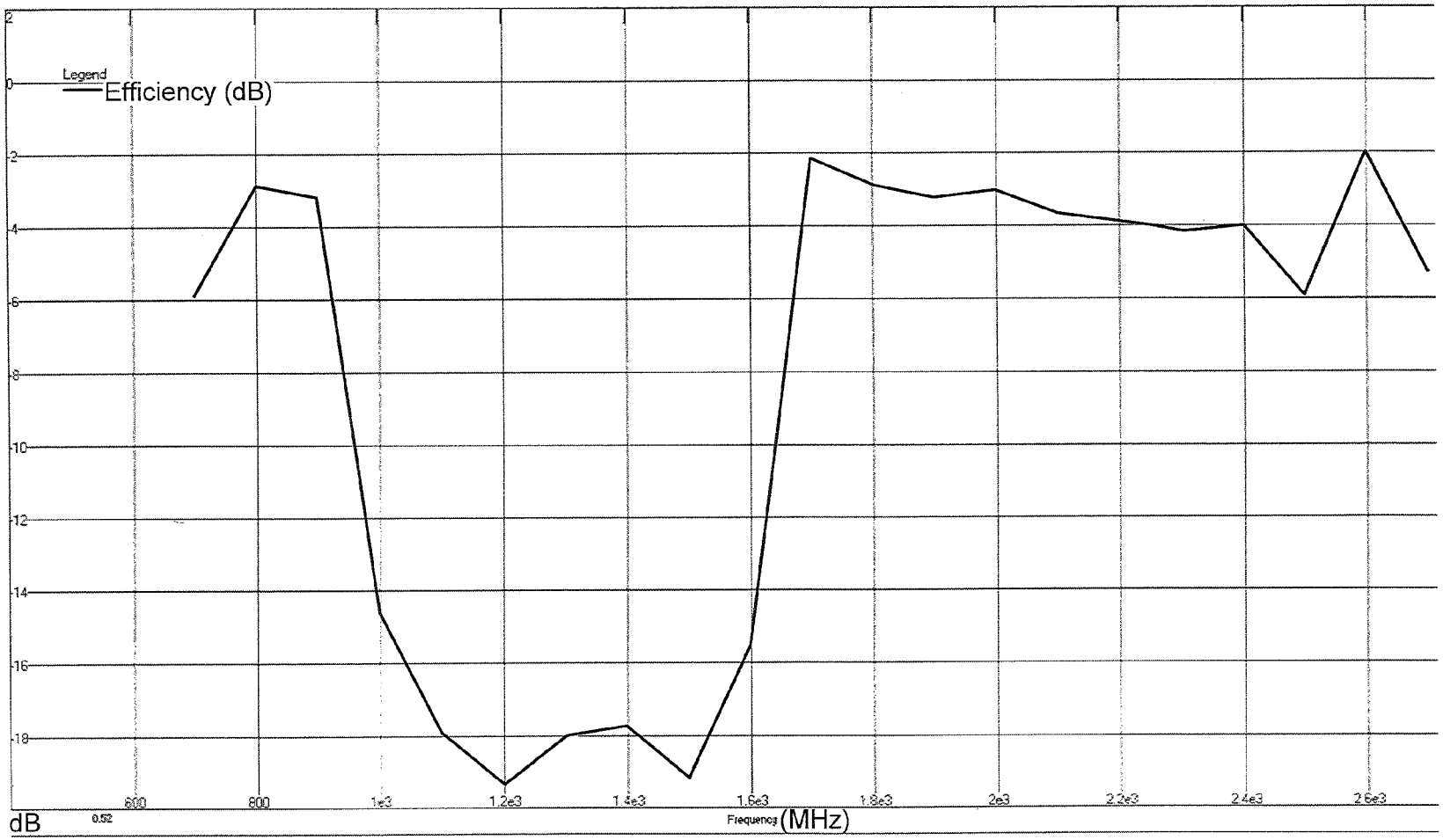
FIGS. 6B and 6C illustrate graphs of gain of wireless electronic devices according to various embodiments of the present inventive concepts.
Figure 6C:
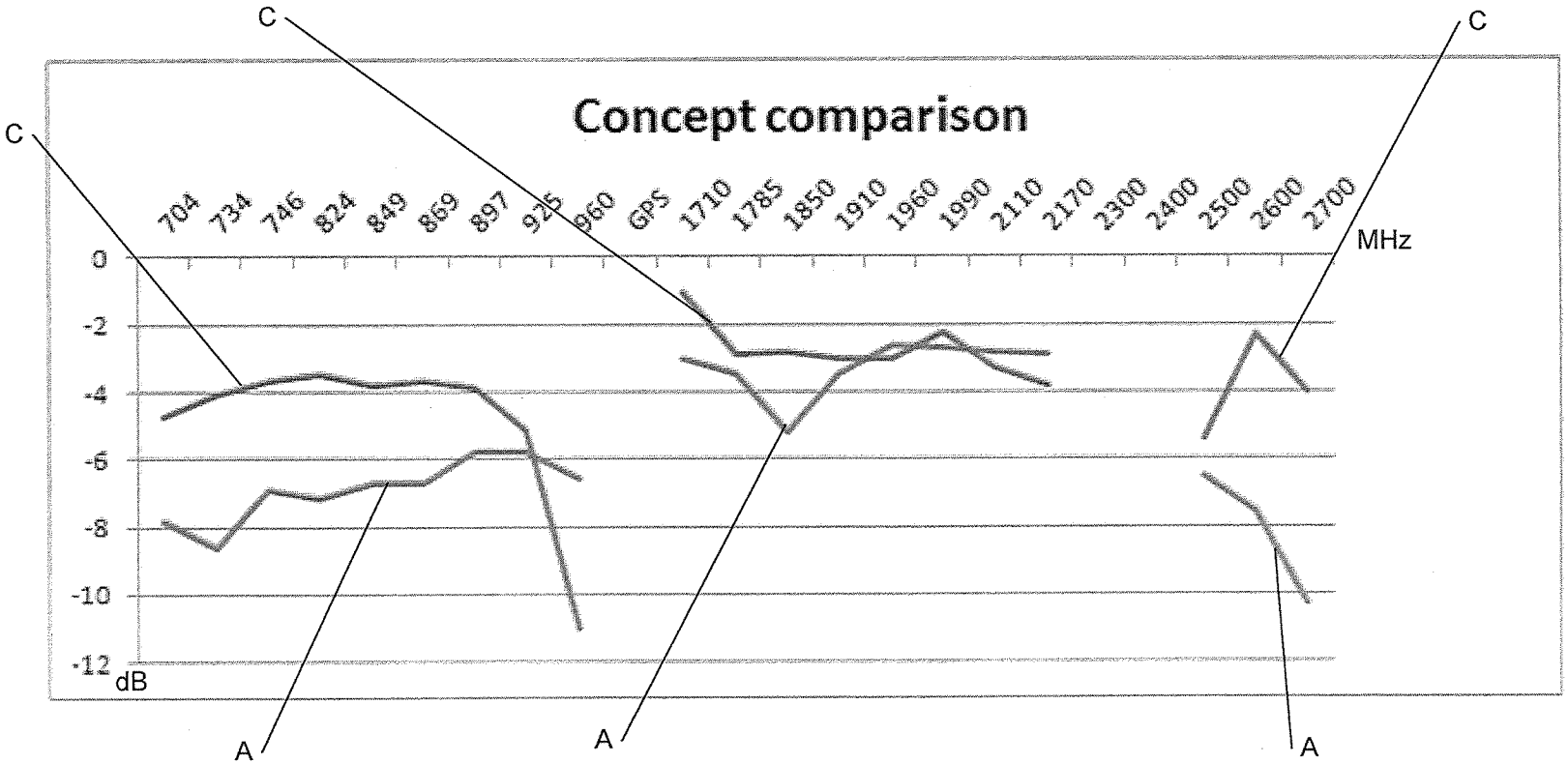

In contrast with FIG. 6A, FIGS. 6B and 6C illustrate graphs of gain of wireless electronic devices 100 according to various embodiments of the present inventive concepts. For example, FIG. 6B illustrates that a wireless electronic device 100 including the feed structure 206 and the third antenna 230, as illustrated in FIG. 2B, provides an improvement in gain for most low-band frequencies. As another example, FIG. 6C illustrates that a wireless electronic device 100 that includes the feed structure 206, the third antenna 230, and the matching component M, as illustrated in FIG. 4A, may provide a 2-4 dB improvement in gain for most low-band frequencies. In particular, this improvement is indicated by a comparison of the C-curves in FIG. 6C versus the A-curves in FIG. 6C, which A-curves correspond to the graph in FIG. 6A. Moreover, FIG. 6C further illustrates a potential improvement in gain for high-band frequencies, especially frequencies above 2400 MHz.

Figure 7A:
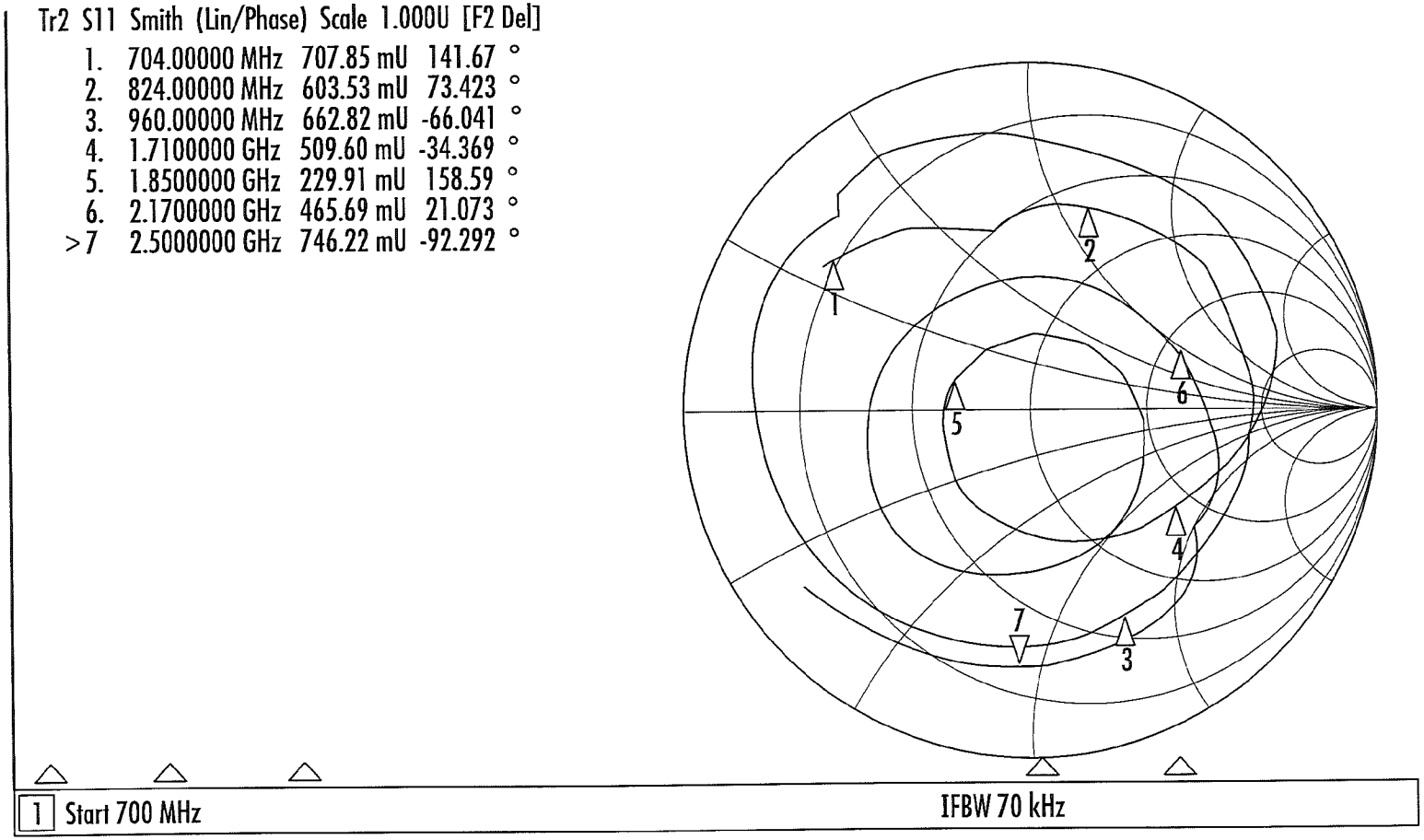
FIG. 7A (PRIOR ART)
FIG. 7A illustrates a Smith chart of a prior art wireless electronic device.

Referring now to FIG. 7A, a Smith chart of a prior art wireless electronic device is illustrated. In particular, the lack of looping (e.g., circling around the center of the Smith chart) in low-band frequencies in the Smith chart in FIG. 7A indicates that a wireless electronic device without the feed structure 206 or the third antenna 230 may provide only a single resonance in low-band frequencies.

Figure 7B:
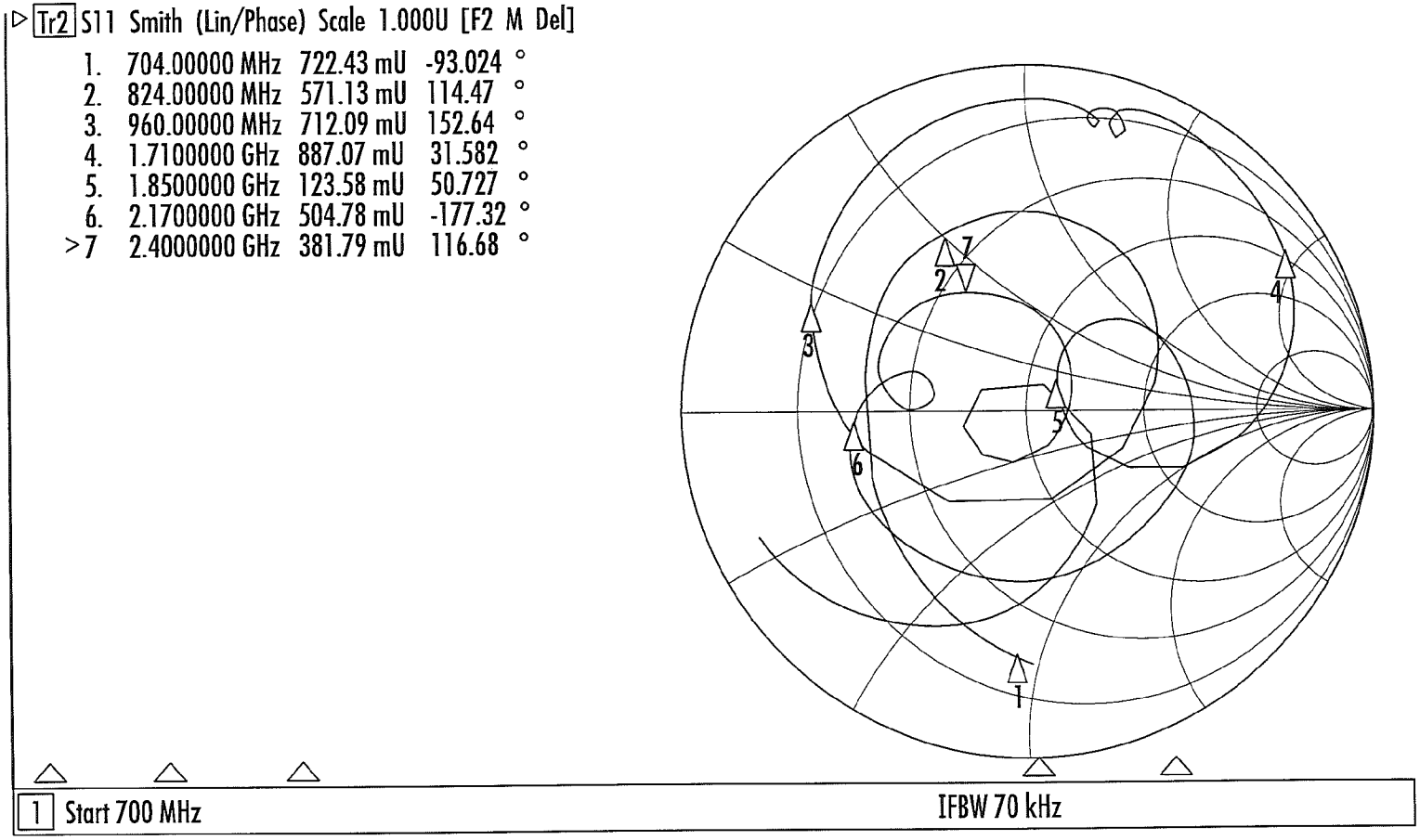
FIGS. 7B and 7C illustrate Smith charts of wireless electronic devices according to various embodiments of the present inventive concepts.
Figure 7C:
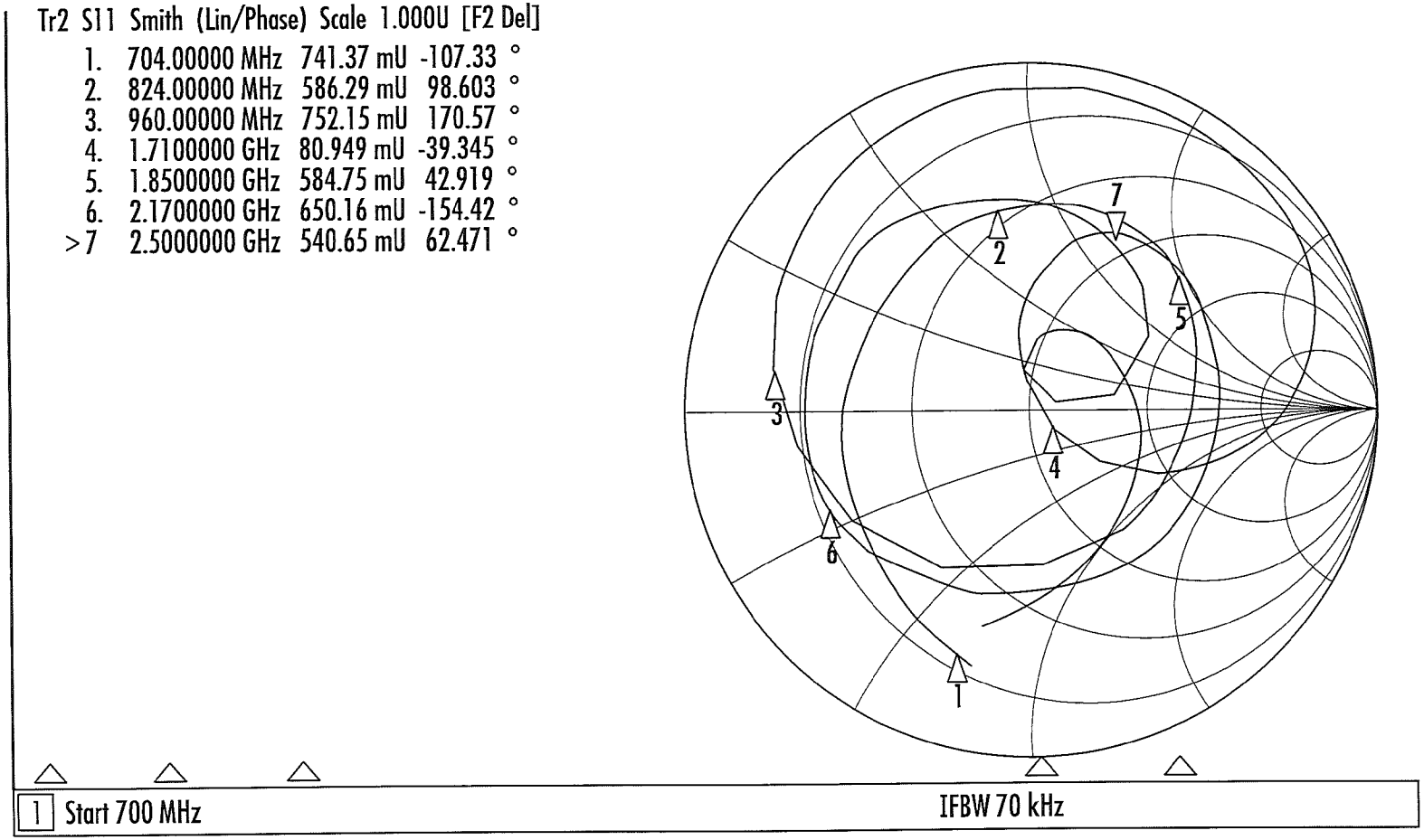

In contrast with FIG. 7A, FIGS. 7B and 7C illustrate Smith charts of wireless electronic devices 100 according to various embodiments of the present inventive concepts. For example, FIG. 7B illustrates that a wireless electronic device 100 including the feed structure 206 and the third antenna 230, as illustrated in FIG. 2B, may provide a loop around the center of the Smith chart in low-band frequencies. Moreover, the Smith chart in FIG. 7B illustrates better matching in low-band frequencies, as well as some improvements in bandwidth for high-band frequencies, in comparison with the Smith chart in FIG. 7A. The improvements in matching are also indicated in the VSWR chart in FIG. 5B. Accordingly, it will be understood that a wireless electronic device 100 including the feed structure 206 and the third antenna 230, as illustrated in FIG. 2B, may provide one or more additional resonances that may improve the antenna gain and bandwidth of the wireless electronic device 100.

As another example, FIG. 7C illustrates that a wireless electronic device 100 that includes the feed structure 206, the third antenna 230, and the matching component M, as illustrated in FIG. 4A, may provide a loop around the center of the Smith chart in low-band frequencies. Moreover, the Smith chart in FIG. 7C illustrates relatively good matching in low-band frequencies, as well as relatively good matching near 1700 MHz.

Figure 8A:
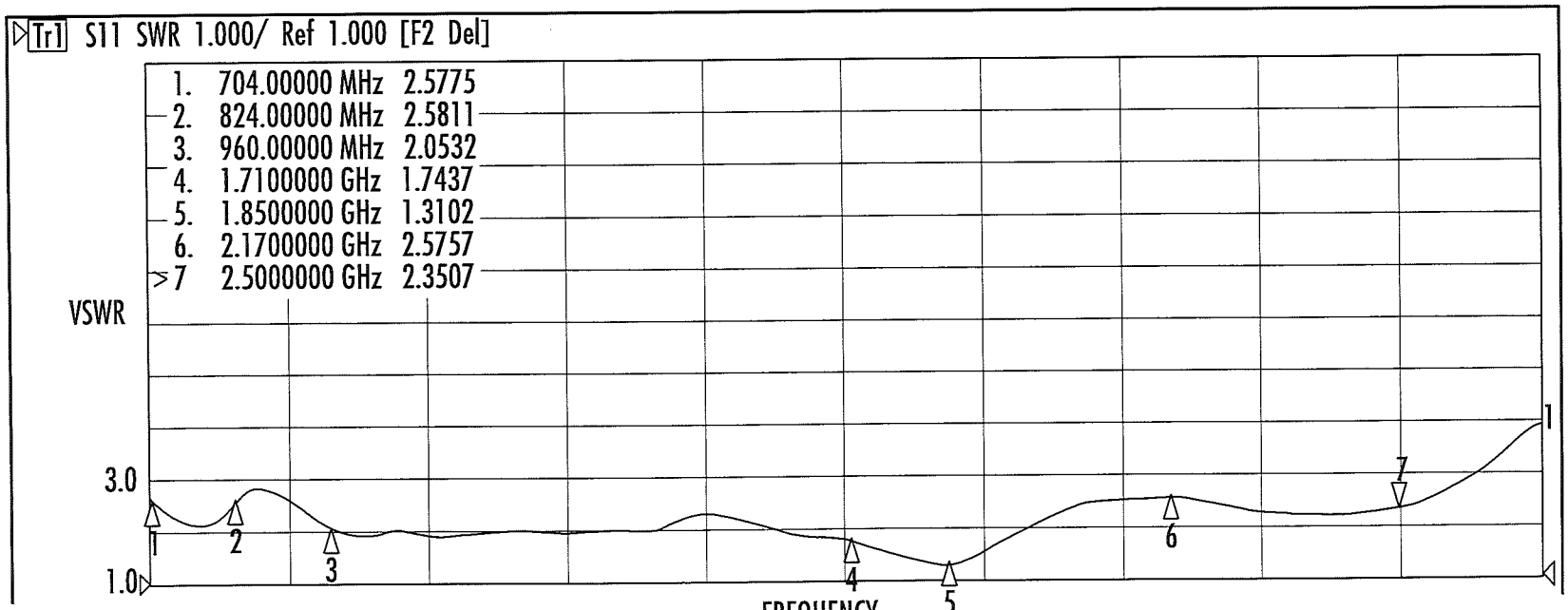
FIG. 8A (PRIOR ART)
FIG. 8A illustrates a VSWR graph of a prior art wireless electronic device loaded with a user's hand.
Figure 8B:
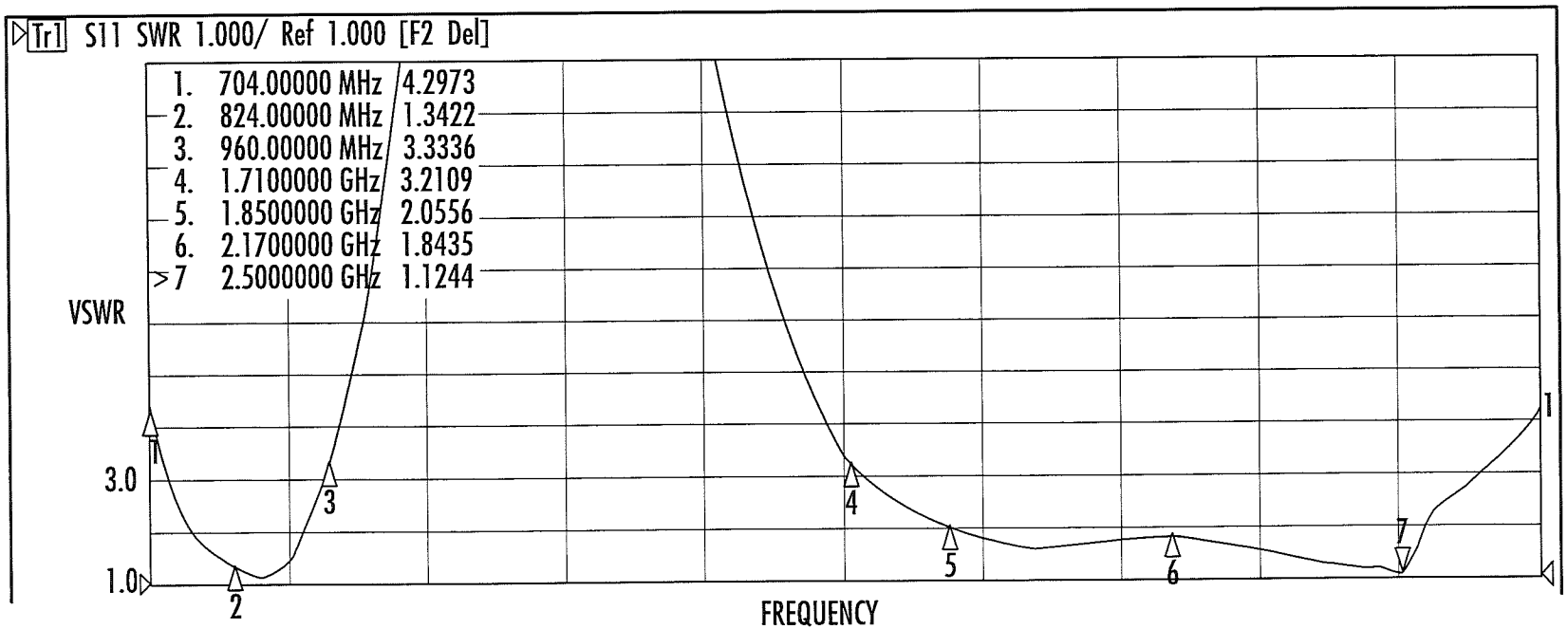
FIG. 8B illustrates a VSWR graph of a wireless electronic device loaded with a user's hand, according to various embodiments of the present inventive concepts.

Referring now to FIG. 8A, a VSWR graph of a prior art wireless electronic device loaded with a user's hand is illustrated. In particular, FIG. 8A illustrates that a wireless electronic device without the feed structure 206 or the third antenna 230 provides a result in which all frequencies approach 50 Ohms when a user's hand is introduced to the wireless electronic device. This result, however, may present coupling issues with noise into a GPS antenna of the wireless electronic device. In contrast, FIG. 8B illustrates a VSWR graph of a wireless electronic device 100 loaded with a user's hand, according to various embodiments of the present inventive concepts. In particular, FIG. 8B illustrates that a wireless electronic device 100 including the feed structure 206 and the third antenna 230, as illustrated in FIG. 2B, may provide resonance frequencies that approach 50 Ohms, whereas intermediate frequencies, such as GPS frequencies, do not approach 50 Ohms.

Figure 9A:
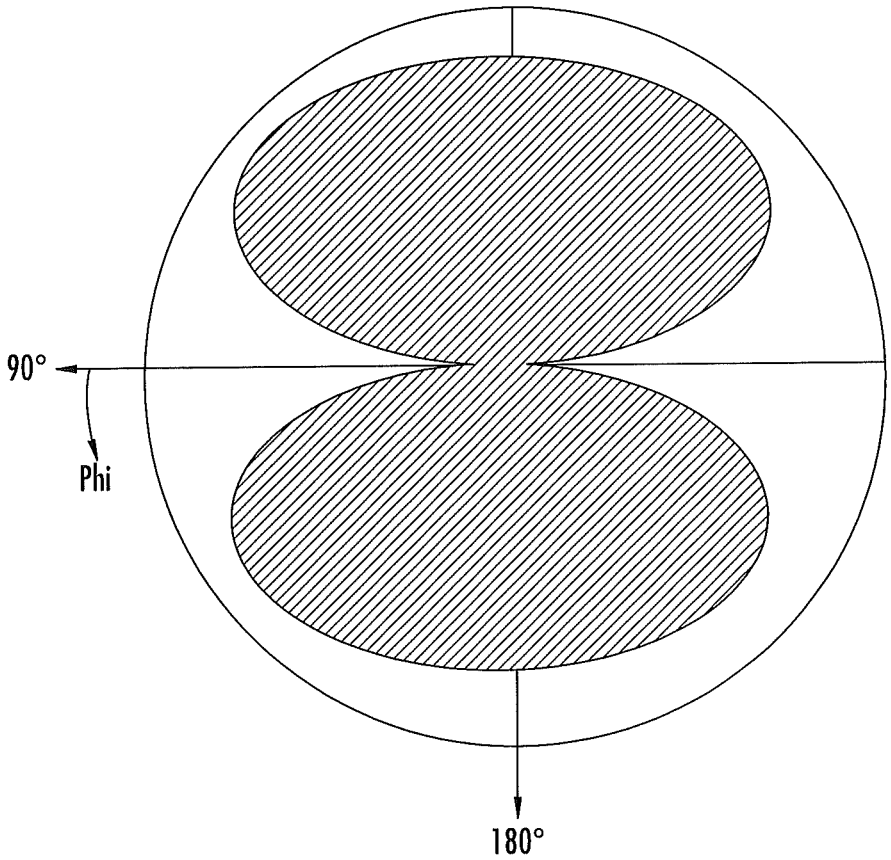
FIGS. 9A-9C illustrate radiation patterns of a wireless electronic device, according to various embodiments of the present inventive concepts.
Figure 9B:
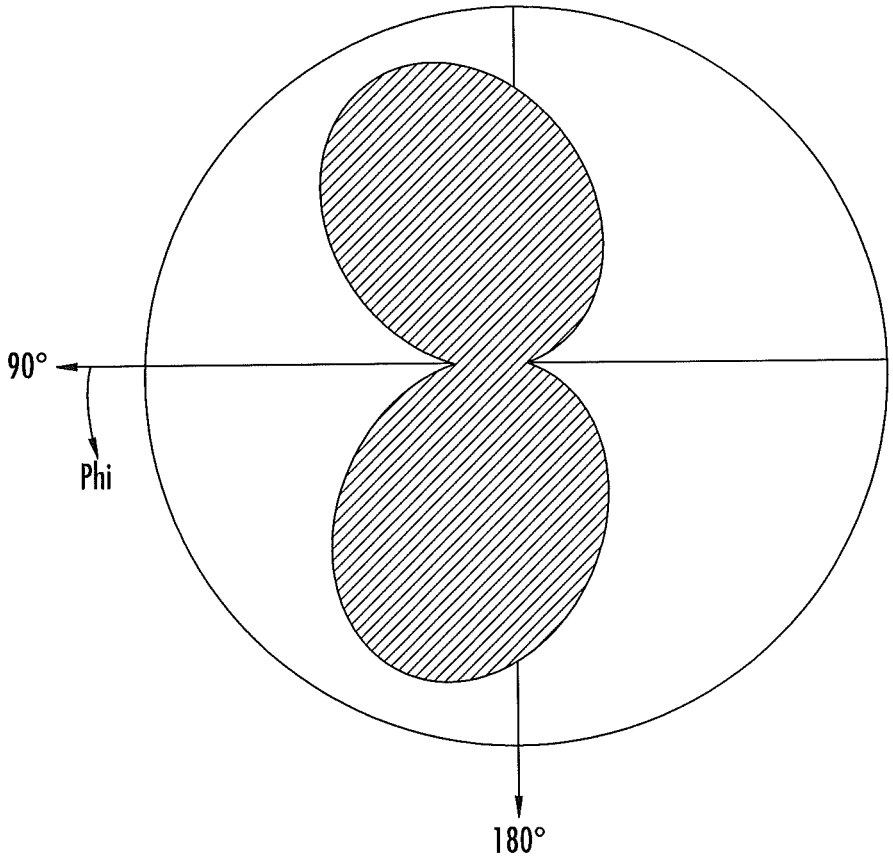
Figure 9C:
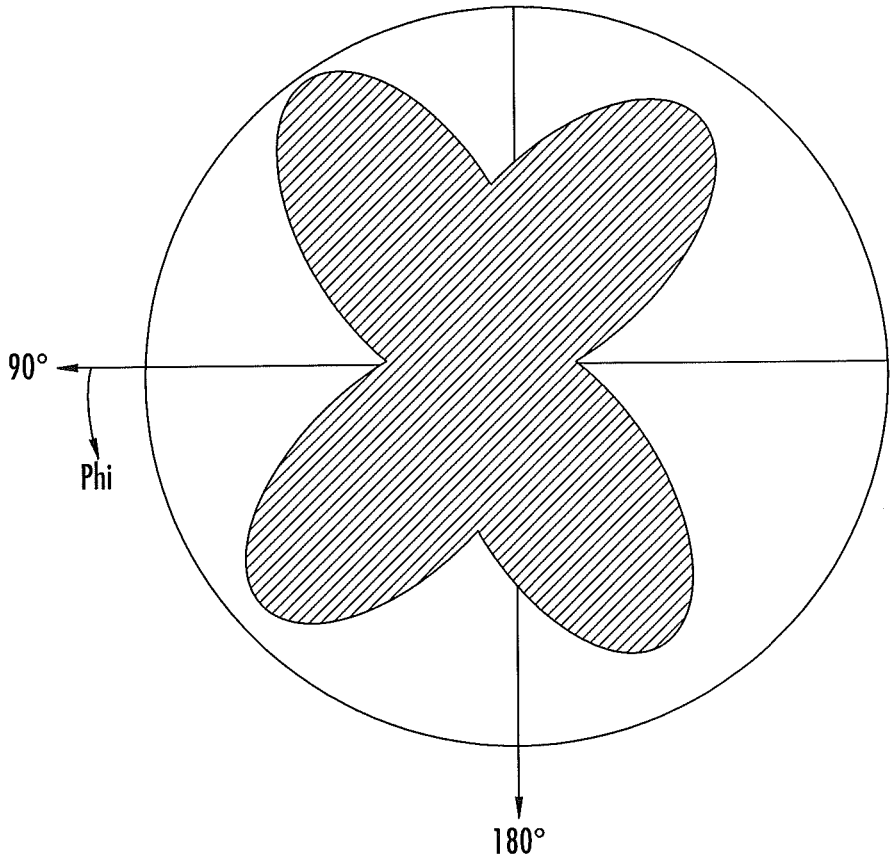

Referring now to FIGS. 9A-9C, radiation patterns of a wireless electronic device 100 (e.g., as illustrated in FIG. 2B) are illustrated, according to various embodiments of the present inventive concepts. Specifically, FIGS. 9A-9C illustrate symmetrical radiation patterns at antenna frequencies of 700 MHz, 900 MHz, and 1900 MHz, respectively. In particular, the symmetrical radiation patterns may be due to the metal perimeter of the wireless electronic device 100, and the symmetrical radiation patterns mean that radiation patterns emitted out of the front and back of the wireless electronic device 100 are the same. Moreover, the structure of the metal perimeter radiator of the wireless electronic device 100 may provide radiation patterns with reduced lobes in low-band frequencies. Also, correlation may be relatively high for wireless electronic devices 100 in each of FIGS. 2B, 4A, and 4B in the 700 MHz band.

Various embodiments described herein may provide additional resonances in high and low bands for the metal perimeter of the wireless electronic device 100 by using the feed structure 206 and the third antenna 230. Moreover, these additional resonances may add bandwidth and improve gain for the metal perimeter of the wireless electronic device 100, especially in the low band.

Many different embodiments have been disclosed herein, in connection with the above description and the drawings. It will be understood that it would be unduly repetitious and obfuscating to literally describe and illustrate every combination and subcombination of these embodiments. Accordingly, the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed various embodiments and, although specific terms are employed, they are used in a generic and descriptive sense only and not for purposes of limitation.

What is claimed is:

1. A wireless electronic device, comprising:

a ground plane;

a metal perimeter around the ground plane, a bottom end of the metal perimeter comprising a first antenna radiating element;

a second antenna radiating element between the ground plane and the bottom end of the metal perimeter; and a feed structure connected to the second antenna radiating element and the metal perimeter, wherein the feed structure extends continuously from the second antenna radiating element along a surface of the metal perimeter to a location adjacent a first discrete ground point that directly connects the metal perimeter and the ground plane, and wherein the location is spaced apart from the second antenna radiating element, wherein:

the feed structure comprises a first coaxial feed line physically connected to the first antenna radiating element of the metal perimeter;

a top end of the metal perimeter comprises a third antenna radiating element, the metal perimeter further comprising first and second side portions that extend between the top end and the bottom end;

the wireless electronic device further comprises a first plurality of discrete ground points at a middle of the first side portion of the metal perimeter;

the wireless electronic device further comprises a second plurality of discrete ground points at a middle of the second side portion of the metal perimeter;

the wireless electronic device further comprises a second coaxial feed line that is spaced apart from the first coaxial feed line on a same one of the first side portion or the second side portion of the metal perimeter as the first coaxial feed line and is physically connected to the third antenna radiating element of the metal perimeter;

the second coaxial feed line extends to a location adjacent a second discrete ground point that directly connects the metal perimeter and the ground plane; and the first and second discrete ground points are both on the same one of the first side portion or the second side portion of the metal perimeter and are included in the first plurality of discrete ground points or the second plurality of discrete ground points.

2. The wireless electronic device of claim 1, wherein the second antenna radiating element comprises a monopole antenna between the ground plane and the first antenna.

3. The wireless electronic device of claim 2, wherein the first antenna radiating element comprises a non-planar antenna radiating element of the metal perimeter.

4. The wireless electronic device of claim 1, further comprising a matching component between the feed structure and the ground plane.

5. The wireless electronic device of claim 4, wherein the matching component is configured to provide a capacitance of about 0.8 picoFarads (pF) to about 1.5 pF.

6. The wireless electronic device of claim 1, wherein:

a non-planar portion of the second coaxial feed line is between the ground plane and a non-planar portion of the metal perimeter.

7. The wireless electronic device of claim 1, wherein the coaxial feed line comprises a non-planar portion that is closer to the discrete ground point than to the second antenna radiating element.

8. The wireless electronic device of claim 1, wherein:

the metal perimeter comprises a non-planar portion comprising at least a portion of the first antenna radiating element;

the feed structure comprises a non-planar portion extending along the non-planar portion of the metal perimeter; and the wireless electronic device further comprises:

a display screen on the ground plane; and a transceiver circuit coupled to the first antenna radiating element and configured to provide communications for the wireless electronic device.

9. The wireless electronic device of claim 1, wherein a portion of the feed structure is both:

between the ground plane and the metal perimeter; and between the second antenna radiating element and the metal perimeter.

10. A wireless electronic device, comprising:

a ground plane;

a display screen on the ground plane;

a metal perimeter around the ground plane, the metal perimeter comprising a non-planar first antenna radiating element;

a second antenna radiating element between the ground plane and the metal perimeter;

a feed structure connected to the second antenna radiating element and the metal perimeter, wherein the feed structure extends continuously from the second antenna radiating element along a surface of the metal perimeter to a location adjacent a ground point connected to the metal perimeter, wherein the location is spaced apart from the second antenna radiating element; and a transceiver circuit coupled to the non-planar first antenna radiating element and configured to provide communications for the wireless electronic device, wherein:

the metal perimeter comprises a top end portion, a bottom end portion, and first and second side portions that extend between the top end portion and the bottom end portion;

a first plurality of ground points is at a middle of the first side portion of the metal perimeter;

a second plurality of ground points is at a middle of the second side portion of the metal perimeter;

a portion of the feed structure is spaced apart from an adjacent side portion of the ground plane and extends parallel to the adjacent side portion of the ground plane and parallel to an adjacent one of the first and second side portions of the metal perimeter;

the feed structure comprises a first coaxial feed line physically connected to the non-planar first antenna radiating element of the metal perimeter;

the metal perimeter further comprises a non-planar third antenna radiating element;

the wireless electronic device further comprises a second coaxial feed line that is on the one of first and second side portions of the metal perimeter and is physically connected to the non-planar third antenna radiating element of the metal perimeter; and the first and second coaxial feed lines are non-overlapping lines, and wherein:

the ground point comprises a first discrete ground point that directly connects the metal perimeter and the ground plane;

the second coaxial feed line extends to a location adjacent a second discrete ground point that directly connects the metal perimeter and the ground plane; and the first and second discrete ground points are both on the one of the first and second side portions of the metal perimeter and are included in the first plurality of ground points or the second plurality of ground points.

11. The wireless electronic device of claim 10, wherein:

the ground point comprises a conductor of the first coaxial feed line.

12. The wireless electronic device of claim 10, wherein the second antenna radiating element comprises a monopole antenna between the ground plane and the non-planar first antenna radiating element.

13. The wireless electronic device of claim 10, further comprising a matching component between the feed structure and the ground plane, wherein the matching component is configured to provide a capacitance of about 0.8 picoFarads (pF) to about 1.5 pF.

14. The wireless electronic device of claim 10, wherein the feed structure comprises a non-planar portion extending along a portion of the non-planar first antenna radiating element.

15. The wireless electronic device of claim 8, wherein the non-planar portion of the feed structure conforms with a shape of the non-planar portion of the metal perimeter.

* * * * *